US005459556A

United States Patent [19]

Acquaviva et al.

[11] Patent Number: 5,459,556

[45] Date of Patent: Oct. 17, 1995

[54] TONER CONSUMPTION RATE GAUGE FOR PRINTERS AND COPIERS

[75] Inventors: Thomas Acquaviva, Penfield; Michael A. Garofalo, Rochester, both of N.Y.

[73] Assignee: Xerox Corporation, Stamford, Conn.

[21] Appl. No.: 181,145

[22] Filed: Jan. 12, 1994

[51] Int. Cl.[6] ..... G03G 15/00

[52] U.S. Cl. ..... 355/209; 118/688; 355/208; 355/246

[58] Field of Search ..... 355/203, 204–206, 355/207, 208, 209, 246, 55, 59, 40, 67, 61; 118/688, 689

[56] References Cited

U.S. PATENT DOCUMENTS

| | | | |
|---|---|---|---|
| 3,821,938 | 7/1974 | Bacon | 118/7 |
| 4,721,978 | 1/1988 | Herley | 355/245 X |
| 4,734,737 | 3/1983 | Koichi | 118/689 X |
| 4,847,659 | 7/1989 | Resch, III | 355/202 |
| 4,908,666 | 3/1990 | Resch, III | 355/246 |
| 4,975,734 | 12/1990 | Mishima | 355/70 |
| 5,006,897 | 4/1991 | Rimai et al. | 355/246 |
| 5,070,363 | 12/1991 | Ito et al. | 355/206 |
| 5,150,159 | 9/1992 | Igawa et al. | 355/243 |
| 5,162,849 | 11/1992 | Yoshino et al. | 355/207 |
| 5,204,698 | 4/1993 | LeSueur et al. | 346/160 |
| 5,204,699 | 4/1993 | Birnbaum et al. | 355/208 X |
| 5,258,783 | 11/1993 | Sasanuma et al. | 358/519 X |
| 5,349,377 | 9/1994 | Gilliland et al. | 355/245 X |

*Primary Examiner*—A. T. Grimley
*Assistant Examiner*—T. A. Dang
*Attorney, Agent, or Firm*—John S. Wagley

[57] ABSTRACT

A toner meter for determining a rate of toner usage per print in a printing machine of the type having operator actuatable settings effecting the rate of toner usage per print. The meter has a controller for calculating the rate of toner usage per print responsive to actuation of an operator actuatable setting and a indicator in communication with the controller, for indicating the calculated rate of toner usage.

25 Claims, 6 Drawing Sheets

TONER CONSUMPTION RATE GAUGE FOR PRINTERS AND COPIERS

The present invention relates to a gauge for printers and copiers. More specifically, the invention relates to a gauge for determining the consumption rate of toner.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the electrophotographic printing process, toner particles are applied to a sheet to form a copy. Toner particles are thus constantly being depleted during the electrophotographic process. The toner particles must be replenished during the electrophotographic process.

Toner is typically stored in the electrophotographic machine in a container or cartridge which is replaceable or refillable. Replacement or refilling of the toner cartridge represents a significant cost. These costs are both in the lost productive copying time during machine cartridge replacement and more importantly, the cost of the toner and replacing toner cartridges.

Due to the significant expense of toner and toner cartridges, machine users obviously desire that their toner usage be minimized and frequently complain when their toner usage exceeds their expectations.

While toner usage depends on the percent of copy covered and the density of covered area, this usage can vary depending on the way in which an operator uses the machine. For example, copy magnification and the original size will affect the percent of the copy covered. The platen being opened will result in a dark border around the copy. The job size may affect toner consumption if a separate patch of toner is not placed upon the photoreceptive member for each copy of the job, thus saving toner when using job sizes of greater than one. Furthermore, the copy shade and the original shade will affect the density of the covered area. Frequently, the operator manually controls these features of the machine by making adjustments to the machine prior to copying. The operator, therefore, has an ability to affect the toner usage per copy. The operator, however, is frequently not aware or fails to remember that by varying the settings on the machine, he or she affects the amount of toner used per copy.

The following disclosures may be relevant to various aspects of the present invention:

U.S. Pat. No. 3,821,938

Patentee: Bacon et al.

Issue Date: Jul. 2, 1974

U.S. Pat. No. 4,847,659

Patentee: Resch, III

Issue Date: Jul. 11, 1989

U.S. Pat. No. 4,908,666

Patentee: Resch, III

Issue Date: Mar. 13, 1990

U.S. Pat. No. 5,162,849

Patentee: Yoshino et al.

Issue Date: Nov. 10, 1992

U.S. Pat. No. 5,204,698

Patentee: LeSueur et al.

Issue Date: Apr. 20, 1993

U.S. application Ser. No. 08/062,971

Applicant: Gilliland et al.

Filed May 17, 1993

The relevant portions of the foregoing disclosures may be briefly summarized as follows:

U.S. Pat. No. 3,821,938 discloses a toner usage sensing system for an electrostatic reproduction apparatus which utilizes multicomponent developer material including electrostatically charged toner to develop electrostatic latent images on a photosensitive plate. The system directly senses the amount of toner consumed by the reproduction process. Since the average toner body charge is constant for a given desired toner concentration, the weight of the electrostatically charged toner consumed is sensed by measuring the charge removed from the developer material during the reproduction process. The developer unit containing the developer material is electrically isolated from the remainder of the reproduction apparatus and grounded through a single connection.

U.S. Pat. No. 4,847,659 discloses an electrostatographic machine which replenishes toner in a developer mix proportionally in response to a toner depletion signal having a value indicative of the rate of toner usage. A second signal is produced having a value proportional to toning contrast. The contrast of proportionality between toner replenishment and the depletion signal is adjusted in response to the second signal value. The toner depletion signal may be indicative of the number of character print signals applied to a print head. The characters are preferably pixels to be toned.

U.S. Pat. No. 4,908,666 discloses a toner replenishment control structure for developer materials which exhibit toning contrast characteristics which vary predictably with the concentration of toner particles in the developer mix, and for developer materials which do not exhibit predictable changes in toning contrast as the toner concentration changes. An electrostatographic machine produces a contrast signal having a value proportional to toning contrast and a concentration signal having a value indicative of the ratio of toner to carrier in the mix, the concentration signal being substantially insensitive to the toning contrast.

U.S. Pat. No. 5,162,849 discloses an image forming apparatus which detects deterioration of developer contained in a developing unit, and if it is the case, the toner is discharged out of the developing unit through a surface of an image carrying member. The apparatus is provided with a sensor to measure toner concentration in developer contained in the developing unit, a drive controller to control a supply amount of toner into the developing unit based on the toner concentration, a calculating unit to obtain average toner supply during a predetermined period, a detecting unit to detect the deterioration of the developer by comparing the average toner supply with a reference date stored in memory.

U.S. Pat. No. 5,204,698 discloses a laser printer in which a latent image is generated on a circulating imaging member in accordance with digital image signals and subsequently developed with toner, the number of pixels to be toned is used as an indication of the rate at which toner is being depleted from the developer mixture. The device for dispensing fresh toner to the developer mixture is operated in dependence on the number of pixels to be toned so that there is a pre-established relationship between the pixel count and the length of time for which the dispensing device is in operation. If the efficiency of the dispensing device falls, the preestablished relationship is adjusted so that the toner density in the developed images remains constant. If a predetermined level of adjustment is reached, it is taken as an indication that the supply of toner in the printer is low, and should be replenished.

U.S. patent application Ser. No. 062,971, filed May 17, 1993, discloses a process known as pixel counting. The toner usage per copy depends upon primarily the percent of the copy that is covered by toner and the density of the covered area. In electrophotographic printers where the document is scanned, commonly known as scanning printers, the areas or pixels, which represent portions of the text, may be used as an indicator of the amount of toner to be used. This pixel counting system is used in conjunction with an algorithm to determine the amount of toner used per page being printed and, subtracting the used toner from the amount of toner in a full container, determines the current toner level. From this current toner level, a toner low warning is presented to the operator.

According to the present invention, there is provided a toner meter for determining a rate of toner usage per print in a printing machine of the type having operator actuatable settings effecting the rate of toner usage per print. The meter comprises a controller for calculating the rate of toner usage per print responsive to actuation of an operator actuatable setting and an indicator in communication with the controller, for indicating the calculated rate of toner usage.

According to the present invention, there is also provided a printing machine of the type having operator actuable settings effecting the rate of toner usage per print. The machine comprises a controller for calculating the rate of toner usage per print responsive to actuation of an operator actuatable setting and an indicator in communication with the controller, for indicating the calculated rate of toner usage.

According to the present invention, there is also provided a method for determining a rate of toner usage per print in a printing machine of the type having operator actuatable settings effecting the rate of toner usage per print. The method comprising the steps of actuating of an operator actuatable setting, transmitting a signal indicative of the setting, receiving the signal at a controller, and calculating the rate of toner usage per print responsive to actuation of an operator actuatable setting.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 6 printing machine will be shown hereinafter schematically and their operation described briefly with reference thereto.

Figure 6:
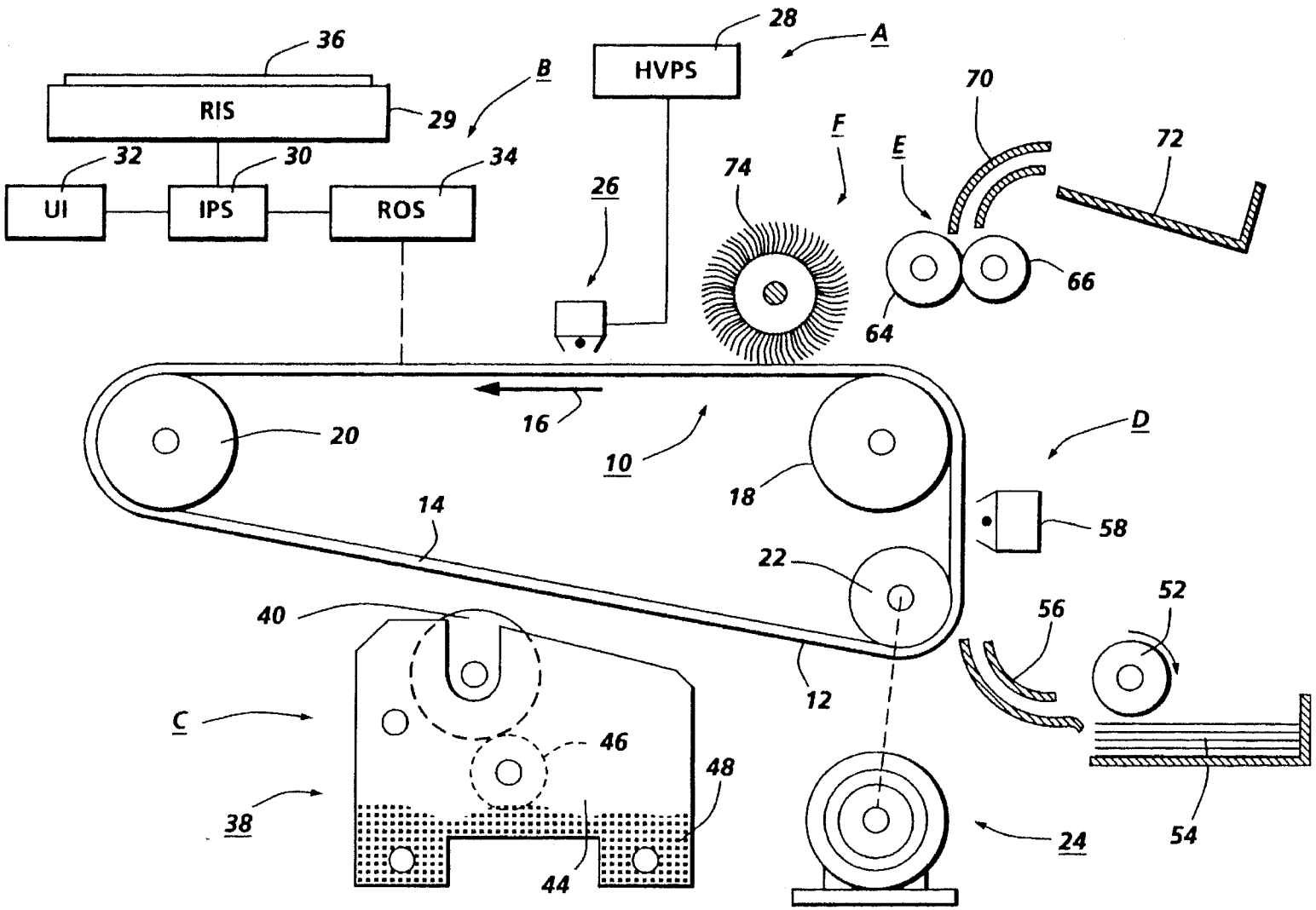
FIG. 6 is a schematic elevational view of an illustrative electrophotographic printing machine incorporating the toner meter of the present invention therein.

Referring initially to FIG. 6, there is shown an illustrative electrophotographic printing machine. The printing machine incorporates a photoreceptor 10 in the form of a belt having a photoconductive surface layer 12 on an electroconductive substrate 14. Preferably the surface layer 12 is made from a selenium alloy. The substrate 14 is preferably made from an aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, potential. A high voltage power supply 28 is coupled to generator 26.

Next, the charged portion of photoconductive surface 12 is advanced through exposure station B. At exposure station B, an original document 36 is positioned on a raster input scanner (RIS), indicated generally by the reference numeral 29. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 30. IPS 30 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 30. The signal corresponding to the desired image is transmitted from IPS 30 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 6. At development station C, a development system 38, develops the latent image recorded on the photoconductive surface. Preferably, development system 38 includes a developing roller 40 positioned adjacent the photoconductive belt 10. The latent image attracts toner particles from the developing roller 40 forming a toner powder image thereon. Developing roller 40 is mounted, at least partially, in the chamber of developer housing 44. The chamber in developer housing 44 stores a supply of developer material 48. The developer material may be a two component developer material of at least magnetic carrier granules having toner particles adhering triboelectrically thereto or may be comprised essentially of toner particles. A transport roller 46 may be disposed interiorly of the chamber of housing 44 and conveys the developer material to the developing roller 40. The transport roller 46 and the developing roller 40 may be magnetized or electrically biased so that the toner particles are attracted first to the transport roller and then to the developing roller.

Again referring to FIG. 6, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
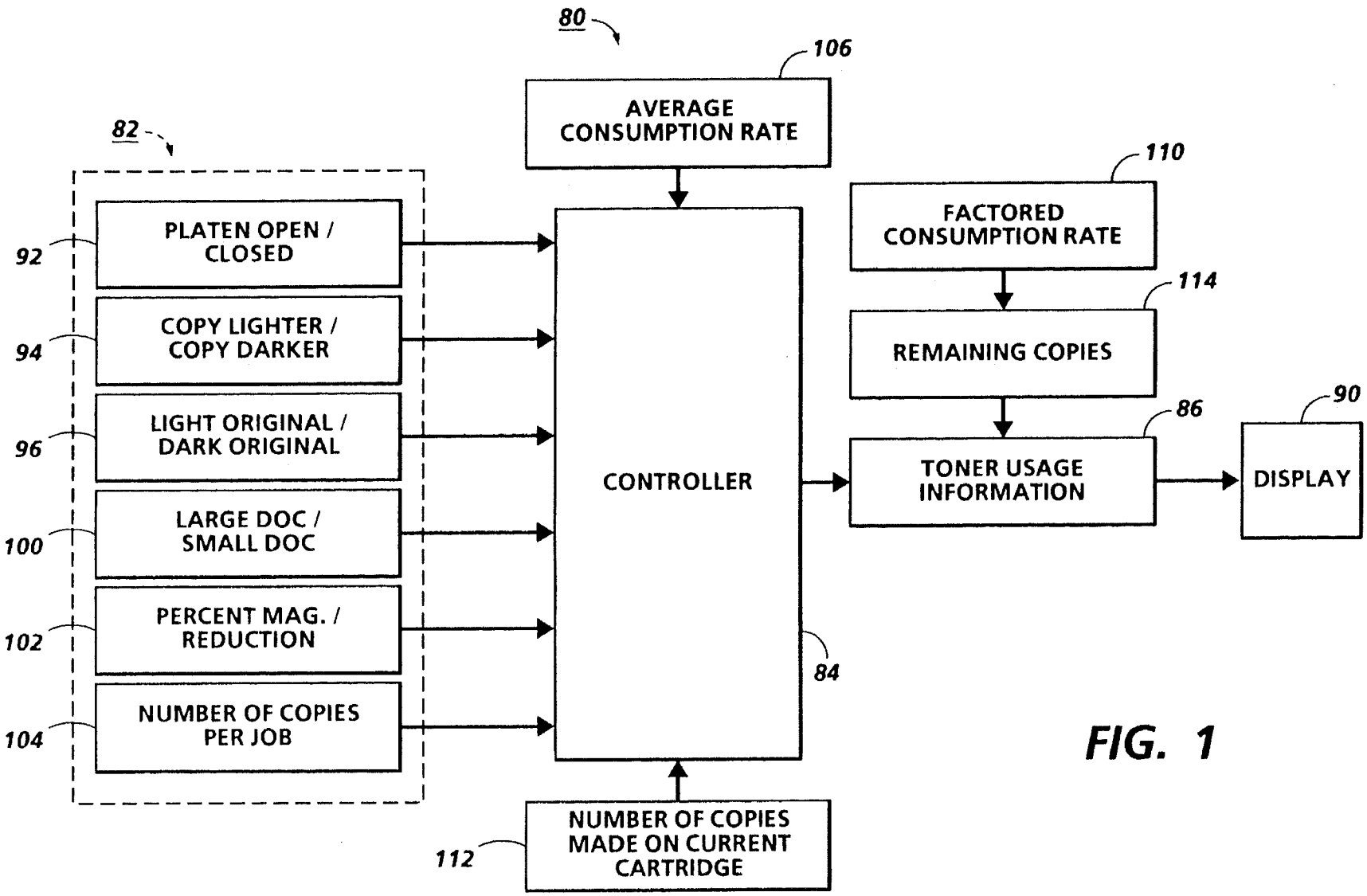
FIG. 1 is a schematic view of a toner usage meter according to the present invention.

Referring now to FIG. 1, according to the present invention, a toner usage meter 80 is schematically described. Signals representing operator variable user settings 82 are sent to controller 84. The controller 84 processes the signals representing the operator variable user settings 82 and conveys a signal representing toner usage information 86 to display 90. The toner usage information 86 is an indication of the current toner usage rate and may be in any suitable form such as one or more of toner usage per copy, usage as compared to a standard i.e., best, average or worst, or remaining copies in the current cartridge based upon current toner usage per copy. The operator variable user settings 82 may include any user setting which effects the toner consumption rate. For example, the settings 82 may include platen open/platen closed setting 92, copy lighter/copy darker setting 94, light original/dark original setting 96, large document/small document setting 100, percent magnification/percent reduction setting 102, and number of copiers per job setting 104. It should be appreciated that other operator user variable settings 82 in addition to those previously stated may be included in the toner usage meter 80. Further, the user settings 82 may be operator variable, such as by pushing a specific button from a series of buttons. Alternatively, the operator variable user settings 82 may be machine determinable such as the light original/dark original signal setting 96 which may be obtained by a preflash sensor (not shown) which looks at light reflected from the original, or a small document/larger document signal setting 100 which may be determined by sensors (not shown) in the document handler as sheets are fed therethrough.

The invention may be practiced with operator variable settings 82 as the only input to controller 84. In such an embodiment of the invention the toner usage information 86 would be calculated based solely upon the particular user settings 82. Preferably, however, the toner meter 80 further includes an average toner usage consumption rate input 106 which is processed by the controller 84 in addition the settings 82. From the average toner consumption rate input 106 and the settings 82, the controller 84 may calculate a factored consumption rate output 110. The factored consumption rate output 110 may serve as the user information 86.

The toner usage meter 80 may further include a number of copies made on the current cartridge input 112. The input 112 as well as the settings 82 and the consumption rate input 106 are processed by the controller 84 to calculate remaining copies at current usage rate number output 114 and the factored consumption rate output 110. The remaining copies output 114 would be calculated based upon the factored consumption rate output 110 subtracted from the number of copies made on the current cartridge input 112.

The controller 84 may have any suitable form, including, but not limited to a programmable controller, a portable computer, or any form of hard or soft logic. Any suitable logic may be devised for use in the controller 84 in order to obtain toner usage information 86. The information 86 may include the factored consumption rate output 110 and the remaining copies output 114 based upon the impact of the user settings 82 upon the consumption rate output 110 and other inputs such as the average consumption rate input 106 and the number of copies made input 112.

Figure 2:
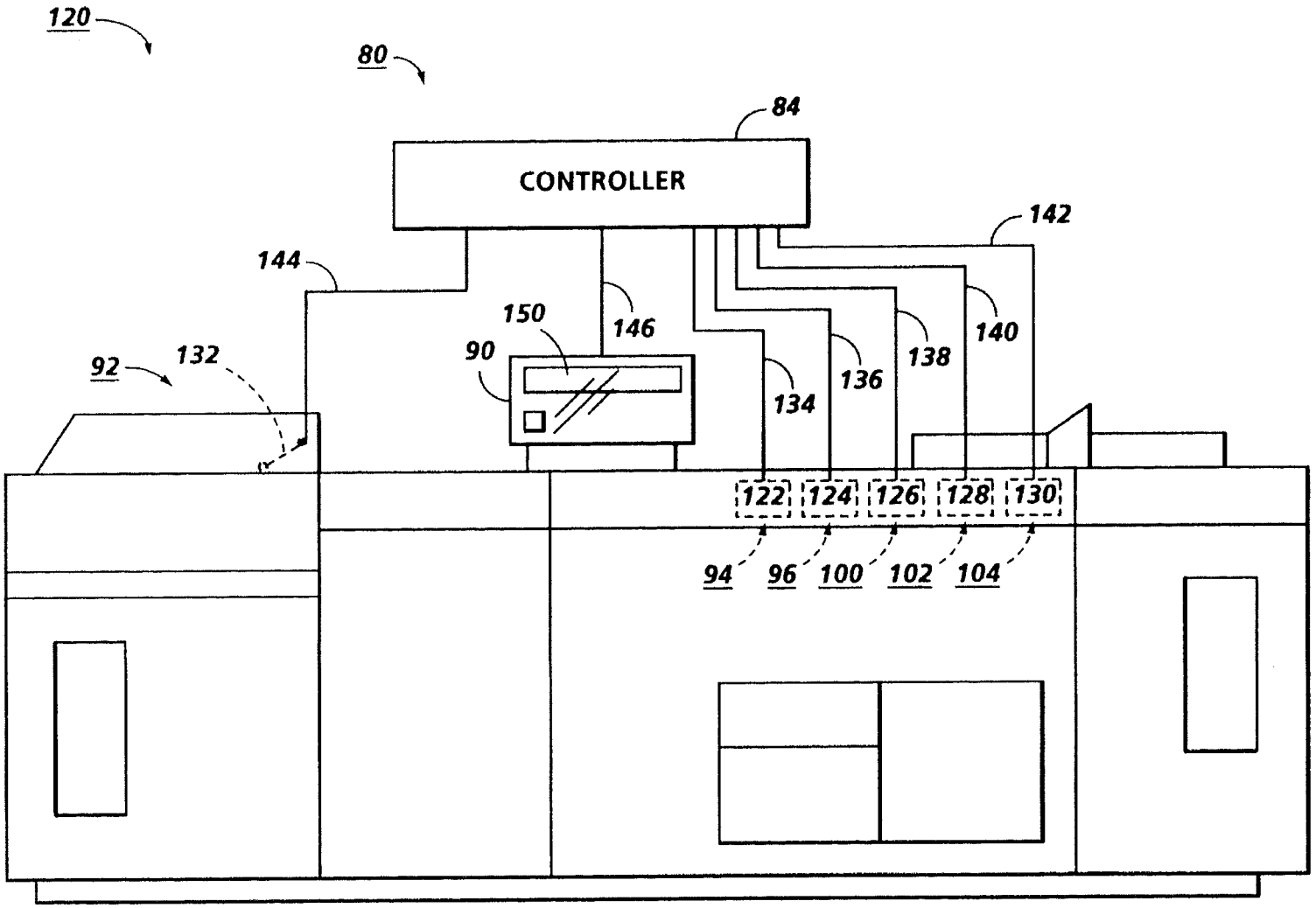
FIG. 2 is a partial schematic diagram of an illustrative electrophotographic printing machine depicting the use of hard controls for the system described in FIG. 1.

Referring now to FIG. 2, an electrographic printing machine 120 is shown having the toner usage meter 80. The toner meter 80 includes the controller 84 which in this embodiment is preferably a commercially available programmable controller. Buttons 122, 124, 126, 128 and 130 are located on the printing machine 120 and correspond to the copy lighter/copy darker setting 94, light original/dark original setting 96, large document/small document setting 100, percent magnification/percent reduction setting 102, and number of copiers per job setting 104, respectively. A platen switch input 132 is used to generate the platen open/platen closed setting 92.

Electrical conduits 134, 136, 138, 140, 142 and 144 transmit signals representing the operator variable user settings 82 to the controller 84 from the buttons 122, 124, 126, 128, 130 and the platen switch 132, respectively. The controller 84 processes the information corresponding to user settings 82 as well as inputs 106 and 112 (see FIG. 1) and transmits toner usage information 86 through conduit 146 to the display 90. Display 90 preferably includes a liquid crystal display 150.

Figure 3:
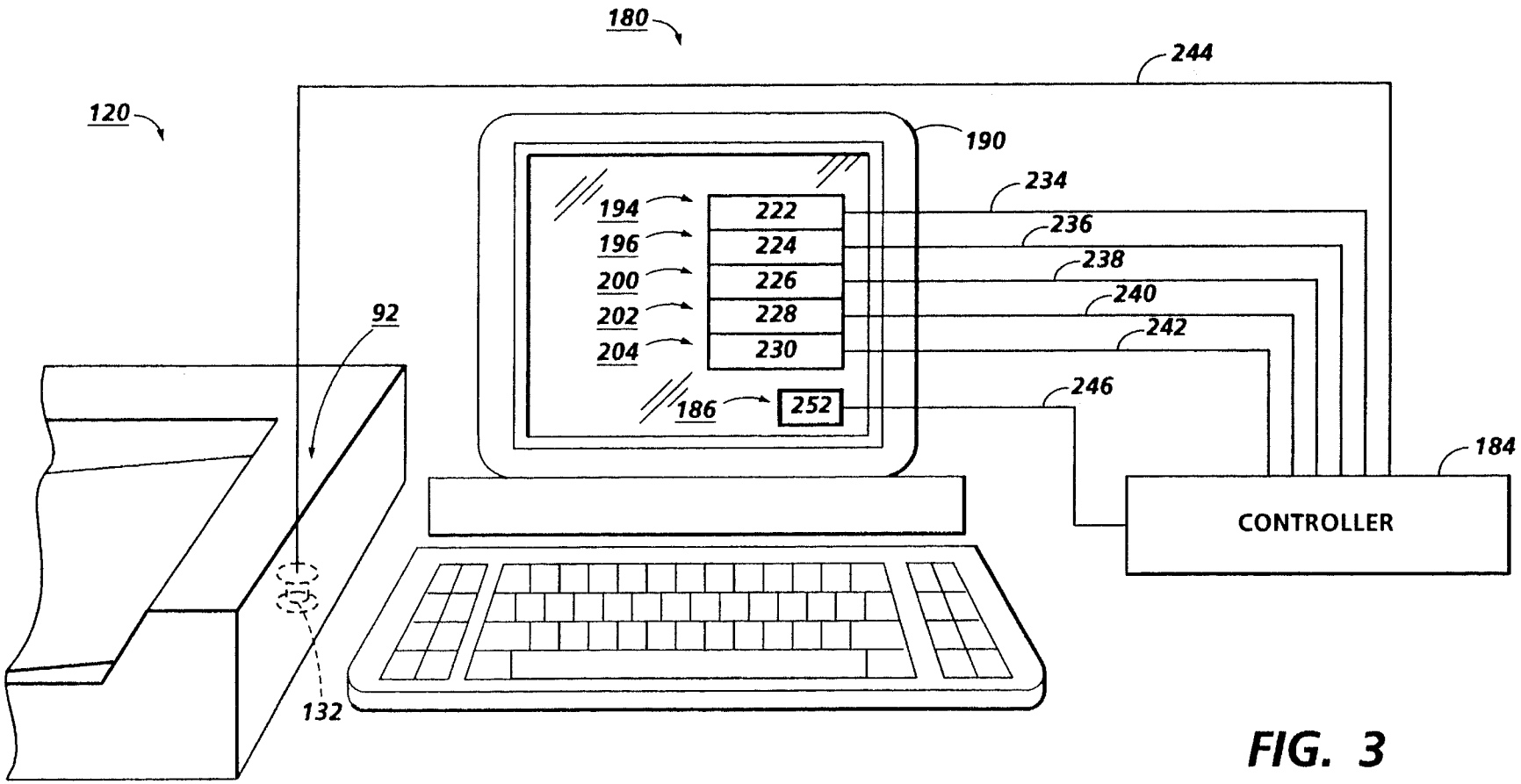
FIG. 3 is a partial schematic diagram of an illustrative electrophotographic printing machine depicting the use of soft controls for the system described in FIG. 1.

Now referring to FIG. 3, an alternate embodiment of the invention is shown of toner usage meter 180 as installed in electrophotographic printing machine 120. The toner meter 180 preferably includes display 190 which includes cathode ray tube (CRT) 250. The cathode ray tube 250 is preferably in the form of a touch screen. The touch screen 250 includes zones 222, 224, 226, 228, and 230 which correspond to copy lighter/copy darker setting 194, light original/dark original setting 196, large document/small document setting 200, percent magnification/percent reduction setting 202, and number of copiers per job setting 204, respectively. Platen switch 32 serves to provide platen open/platen closed setting 92. Conduits 234, 236, 238, 240, and 242 convey signals representing the user settings 82 from touch zones 222, 224, 226, 228, and 230, respectively, to controller 184. Conduit 244 is used to transmit a signal corresponding to the platen open/platen closed setting 92 from the platen switch 232 to the controller 184. The user settings 92, 194, 196, 200, 202 and 204, as well as inputs 106 and 112 (see FIG. 1) are processed in the controller 184 and toner usage information 186 is transferred by conduit 246 to display touch zone 252 on the CRT 250.

Figure 4:
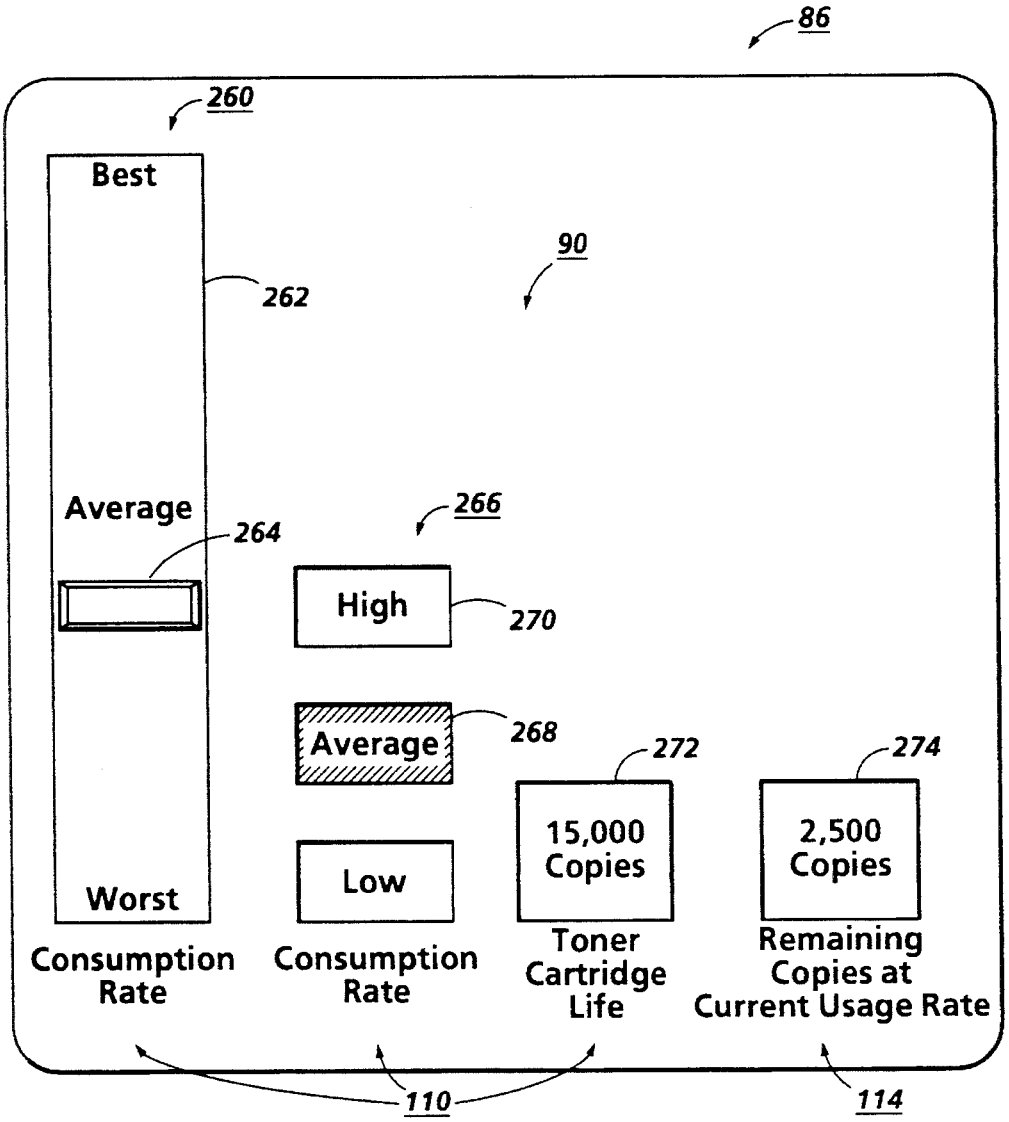
FIG. 4 depicts illustrative examples of various forms of toner meter displays of the electrophotographic printing machine of FIG. 2.

Now referring to FIG. 4, toner usage information 86 may be displayed at display 90 in any of a series of formats. For example, where the toner usage information 86 is in the form of the consumption rate output 110, the display 90 may be in the form of a thermometer 260. The thermometer 260 includes a scale 262 including, for example, the words best, average, and worst to describe the best, average, and worst consumption rate. The thermometer 260 further includes an indicator 264 for illuminating the area corresponding to the appropriate word such as worst, etc. The indicator 264 may be in the form of liquid crystal display (LCD) or light emitting diodes (LEDs). The LCD 264 illuminates beside the scale 262 to indicate the current consumption rate output 110.

Alternatively, where the toner usage information 86 is in the form of the consumption rate output 110, the display 90 may be displayed in the form of an illuminated message 266. The message 266 may include light emitting diodes 268 having words 270 such as low, average, and high which are correspondingly illuminated when the corresponding consumption rate output 110 is obtained.

Alternatively, the toner consumption rate output 110 and the remaining copies output 114 may be displayed numerically. These outputs 110 and 114 may both be displayed on the same display (see FIG. 5) or either of the outputs 110 or 114 may be singularly displayed as illustrated in FIG. 4. Consumption rate number 272 and remaining copies number 274 corresponding to the toner consumption rate output 110 and the remaining copies output 114, respectively, can be displayed with a mechanical, liquid crystal, light emitting diode, or cathode ray tube display. It should be appreciated that the toner usage information 86 may be displayed in any other suitable format.

Figure 5:
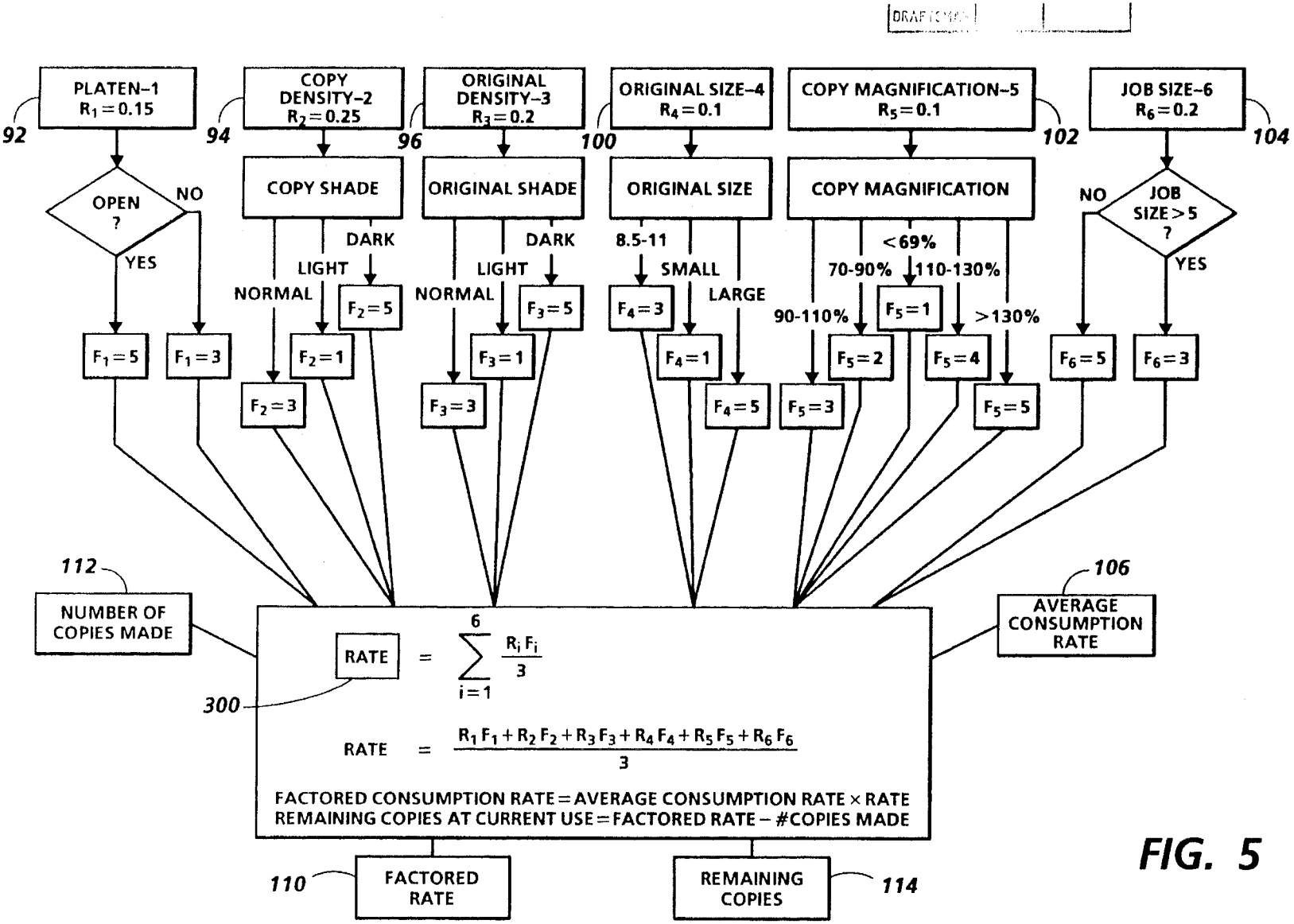
FIG. 5 is a schematic view of an embodiment of a toner usage meter including logic according to the present invention.

While the invention may be practiced with the toner meter 80 utilizing the controller 84 with any suitable logic, an exemplary logic is shown in FIG. 5. In the logic shown in FIG. 5, each of the six operator variable user settings 82 is assigned a usage value $F_i$ and a weight factor $R_i$. The weight factor $R_i$ reflects the relative importance of that particular setting to the toner consumption. The usage value $F_i$ is the factor associated with that particular operator setting. The logic calculates a rate 300 which when multiplied by the average consumption rate input 106 will determine a factored consumption rate output 110. When the number of copies made input 112 is subtracted from the factored rate output 110, the remaining copies at current usage output 114 may be determined. For example, associated with FIG. 5, the platen cover interlock setting 92 is given a platen cover weighting factor $R_1$ of 0.15. The copy density setting 94 is given a copy density weight factor $R_2$ of 0.25. The original density setting setting 96 is given an original density weight factor $R_3$ of 0.2. The document size setting 100 is given a document size weight factor $R_4$ of 0.10. The magnification ratio setting 102 is given a magnification ratio weight factor $R_5$ of 0.10. The job size setting 104 is given a job size weight factor $R_6$ of 0.20.

Further referring to FIG. 5, each of the user settings 82 are given usage values to correspond to the particular setting the operator has made to the machine. For example, a platen cover usage value $F_1$ equal to 5 is given for the platen cover being open and a platen cover usage value $F_1$ equals 3 is given for the platen cover being closed. Copy density usage values $F_2$ of 3, 1, and 5 correspond to the copy sheet being normal, light and dark, respectively. Original density usage values $F_3$ of 3, 1 and 5 are given for the original density being normal, light, or dark, respectively. Document size usage values $F_4$ of 3, 1 and 5 are given for the document size being 8½×11, small or large, respectively. Magnification ratio usage values $F_5$ of 3, 2, 1, 4 and 5 are given for the magnification ratio being 90 to 110 percent, 70 to 90 percent, below 69 percent, 110 to 130 percent, and above 130 percent, respectively. Job sizes usage values $F_6$ of 5 and 3 are given to the job size being 6 or above and below 6, respectively. The usage value $F_i$ of 3 is given to the factor or condition associated with normal toner usage. Therefore, to normalize the rate 300, the $R_iF_i$ products are divided by 3. The logic of FIG. 5 is also shown in Table I.

TABLE 1

| | Factors | |
|---|---|---|
| Input Parameter | $F_i$ = Usage Value | $R_i$ = Weight Factor |
| Platen open | 5 | .15 |
| Platen closed | 3 | .15 |
| Copy normal | 3 | .25 |
| Copy lighter | 1 | .25 |
| Copy darker | 5 | .25 |
| Normal original | 3 | .2 |
| Light original | 1 | .2 |
| Dark original | 5 | .2 |
| 8½ × 11 size | 3 | .1 |
| Small original | 1 | .1 |
| Large original | 5 | .1 |
| 100% mag. | 3 | .1 |
| 70–90% mag. | 2 | .1 |
| <70% mag. | 1 | .1 |
| 110–130% mag. | 4 | .1 |

TABLE 1-continued

| | | |
|---|---|---|
| >130% mag. | 5 | .1 |
| 1–5 copy/job | 5 | .2 |
| >5 copy/job | 3 | .2 |

Rate = $\Sigma i_{=1 \text{ to } n} R_i F_i/3$
Normal usage = (.15 × 3 + .25 × 3 + .2 × 3 + .1 × 3 + .1 × 3 + .2 × 3)/3 = 1.0
Highest usage = (.15 × 5 + .25 × 5 + .2 × 5 + .1 × 5 + .1 × 5 + .2 × 5)/3 = 1.67
Lowest usage = (.15 × 3 + .25 × 1 + .2 × 1 + .1 × 1 + .1 × 1 + .2 × 3)/3 = 0.57
If .9< R≦1.1 = average
.9≦ R = low
R>1.1 = high
or
If .9< R≦1.1 = average
.75<R≦.9 = good
R≦.75 = best
1.1<R≦1.3 = poor
R>1.3 = worst
or
Assume expected life of a cartridge = E = 20,000 copies
Toner cartridge life at current rate = E/R
Cartridge life would be a number between 12,000 and 35,000 with an average being 20,000
If the amount of toner used is X % of the original cartridge life
Amount of toner remaining = (1–X) × E
Number of copies remaining at present rate = ((1–X) × E)/R While the embodiments described in FIGS. 1-6 describe monocolor electrophotographic machines, the invention is likewise well suited for multicolor machines. The high cost of colored toners may make this invention particularly well suited for multicolor machines. For multicolor machines, a separate toner usage meter or a selector switch may be employed to indicate the usage of each color of toner. Thus, the operator could be informed of the usage of each color of toner.

While the present invention has been described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

We claim:

1. A toner meter for determining a rate of toner usage per print in a printing machine of the type having operator actuatable settings effecting the rate of toner usage per print, comprising:

a controller for calculating the rate of toner usage per print responsive to actuation of an operator actuatable setting; and means, in communication with said controller, for displaying the calculated rate of toner usage.

2. A toner meter for determining a rate of toner usage per print in a printing machine of the type having operator actuatable settings effecting the rate of toner usage per print, comprising:

a controller for calculating the rate of toner usage per print responsive to actuation of an operator actuatable setting; and means, in communication with said controller, for indicating the calculated rate of toner usage, wherein one of the operator actuatable settings comprises a switch adapted to transmit a signal indicating that the platen is opened or closed to said controller.

3. A toner meter as in claim 1, wherein one of the operator actuatable settings comprises means for transmitting a signal indicating a setting corresponding to copy lighter or copy darker to said controller.

4. A toner meter as in claim 1, wherein one of the operator actuatable settings comprises means for transmitting a signal indicating a setting corresponding to light original or dark original to said controller.

5. A toner meter as in claim 1, wherein one of the operator actuatable settings comprises means for transmitting a signal indicating a setting corresponding to large document or small document to said controller.

6. A toner meter as in claim 1, wherein one of the operator actuatable settings comprises means for transmitting a signal indicating a setting corresponding to percentage magnification or percentage reduction to said controller.

7. A toner meter as in claim 1, wherein one of the operator actuatable settings comprises means for transmitting a signal indicating a setting corresponding to number of copies per job to said controller.

8. A toner meter as in claim 1, wherein said indicating means comprises a liquid crystal display.

9. A toner meter as in claim 1, wherein said indicating means comprises a cathode ray tube.

10. A toner meter as in claim 1, wherein said controller comprises a logic circuit having a weighting factor assigned to each-of the operator actuatable settings with the rate of toner usage being a function of the weighting factor and operator actuatable setting.

11. A toner meter as in claim 1, wherein said controller calculates an average toner consumption rate.

12. A toner meter as in claim 1, wherein said controller calculates toner cartridge life.

13. A printing machine of the type having operator actuatable settings effecting the rate of toner usage per print, the machine comprising:

a controller for calculating the rate of toner usage per print responsive to actuation of an operator actuatable setting; and means, in communication with said controller, for displaying the calculated rate of toner usage.

14. A printing machine of the type having operator actuatable settings effecting the rate of toner usage per print, the machine comprising:

a controller for calculating the rate of toner usage per print responsive to actuation of an operator actuatable setting; and means, in communication with said controller, for indicating the calculated rate of toner usage, wherein one of the operator actuatable settings comprises a switch adapted to transmit a signal indicating that the platen is opened or closed to said controller.

15. A printing machine as in claim 13, wherein one of the operator actuatable settings comprises means for transmitting a signal indicating a setting corresponding to copy lighter or copy darker to said controller.

16. A printing machine as in claim 13, wherein one of the operator actuatable settings comprises means for transmitting a signal indicating a setting corresponding to light original or dark original to said controller.

17. A printing machine as in claim 13, wherein one of the operator actuatable settings comprises means for transmitting a signal indicating a setting corresponding to large document or small document to said controller.

18. A printing machine as in claim 13, wherein one of the operator actuatable settings comprises means for transmitting a signal indicating a setting corresponding to percentage magnification or percentage reduction to said controller.

19. A printing machine as in claim 13, wherein one of the operator actuatable settings comprises means for transmitting a signal indicating a setting corresponding to number of copies per job to said controller.

20. A printing machine as in claim 13, wherein said indicating means comprises a liquid crystal display.

21. A printing machine as in claim 13, wherein said indicating means comprises a cathode ray tube.

22. A printing machine as in claim 13, wherein said controller comprises a logic circuit having a weighting factor assigned to each of the operator actuatable settings with the rate of toner usage being a function of the weighting factor and operator actuatable setting.

23. A printing machine as in claim 13, wherein said controller calculates an average toner consumption rate.

24. A printing machine as in claim 13, wherein said controller calculates toner cartridge life.

25. A method for determining a rate of toner usage per print in a printing machine of the type having operator actuatable settings effecting the rate of toner usage per print, the method comprising the steps of:

actuating of an operator actuatable setting;

transmitting a signal indicative of said setting;

receiving said signal at a controller;

calculating the rate of toner usage per print responsive to actuation of an operator actuatable setting; and displaying the calculated rate of toner usage.

* * * * *